US006527284B2

(12) United States Patent
Bert

(10) Patent No.: US 6,527,284 B2
(45) Date of Patent: Mar. 4, 2003

(54) SKATEBOARD

(75) Inventor: Anthony Bert, Annecy le Vieux (FR)

(73) Assignee: Salomon S.A., Metz-Tessy (FR)

( * ) Notice: Subject to any disclaimer, the term of this patent is extended or adjusted under 35 U.S.C. 154(b) by 0 days.

(21) Appl. No.: 09/886,275

(22) Filed: Jun. 22, 2001

(65) Prior Publication Data

US 2002/0030338 A1 Mar. 14, 2002

(30) Foreign Application Priority Data

Jun. 23, 2000 (FR) ..... 00 08195

(51) Int. Cl.[7] ..... B62M 1/00
(52) U.S. Cl. ..... 280/87.041; 280/87.042
(58) Field of Search ..... 280/87.041, 87.042, 280/87.021, 87.01, 610, 11.27, 11.28, 14.2

(56) References Cited

U.S. PATENT DOCUMENTS

| | | | | | |
|---|---|---|---|---|---|
| 4,076,265 | A | | 2/1978 | Eash | 280/87.04 A |
| 4,109,925 | A | * | 8/1978 | Williams et al. | 280/11.28 |
| 4,166,629 | A | * | 9/1979 | List | 280/11.28 |
| 4,295,656 | A | | 10/1981 | Moore | 280/87.04 A |
| 5,195,781 | A | * | 3/1993 | Osawa | 280/842 |
| 5,492,357 | A | * | 2/1996 | Fagot | 280/602 |
| 5,649,717 | A | * | 7/1997 | Augustine et al. | 280/610 |
| 5,879,013 | A | * | 3/1999 | Shih | 280/11.28 |
| 6,056,302 | A | * | 5/2000 | Smith | 280/87.042 |
| 6,105,978 | A | * | 8/2000 | Vuerchoz | 280/11.27 |
| 6,182,986 | B1 | * | 2/2001 | Smith | 280/87.042 |
| 6,182,987 | B1 | * | 2/2001 | Bryant | 280/87.042 |
| 6,214,142 | B1 | * | 4/2001 | Saputo | 156/92 |

FOREIGN PATENT DOCUMENTS

| | | |
|---|---|---|
| DE | 9206178 | 10/1992 |

* cited by examiner

*Primary Examiner*—Lesley D. Morris
*Assistant Examiner*—Tony Winner
(74) *Attorney, Agent, or Firm*—Greenblum & Bernstein, P.L.C.

(57) ABSTRACT

A skateboard deck of the type having a plurality of layers including an upper surface layer on which the skater takes position, a lower surface layer in the vicinity of which the wheels of the skateboard are positioned, and one or several intermediate layers, the deck further including a reinforcement arranged in at least one of the following zones: at the front of the deck, in the area where the front wheels are fixed, at the rear in the area where the rear wheels are fixed, on the periphery of the deck, with the reinforcement being inserted between the upper surface layer and the lower surface layer. The reinforcement also includes a projecting portion extending through the lower surface layer of the deck.

18 Claims, 4 Drawing Sheets

SKATEBOARD

CROSS-REFERENCE TO RELATED APPLICATIONS

This application is based upon French Patent Application No. 00 08195, filed Jun. 23, 2000, the disclosure of which is hereby incorporated by reference thereto in its entirety, and the priority of which is claimed under 35 U.S.C. §119.

BACKGROUND OF THE INVENTION

1. Field of the Invention

The present invention relates to a skateboard and to the deck of a skateboard.

2. Description of Background and Relevant Information

A skateboard is generally constituted of a deck beneath which two devices for holding an axle are fixed. Generally, each of the holding devices is directional, and the axle which they hold supports two wheels. Such devices for directional holding of an axle are commonly referred to as trucks.

The trucks make it possible to control the direction of the skateboard, while the skater has both feet positioned on the deck and moves with the latter by rolling. The control of the direction is carried out by shifting the skater's weight to one side or the other.

The construction of these trucks is drawn from roller skates including two axles each having two wheels, i.e., so-called quad skates, and includes mainly two elements, a base plate that ensures the fixing of the truck beneath the deck and a hanger.

One of the ends of the hanger is extended along a first axis and pivots about a point located in the base plate. This end, also called the pivot, penetrates into a recess that is provided in the base plate. A second end of the hanger has a protuberance called a ring. The latter is held by means of two elastomeric pieces called buffers and a kingpin oriented along a second axis applied on the base plate. Finally, a third end of the hanger serves as a support for an axle on which two wheels are mounted, this axle being oriented along a third axis.

The orientation of the three axes of the hanger in relation to one another is such that the inclination of the deck on either of its lateral edges, i.e., along a longitudinal axis of the deck, creates a pivoting of the axle along a vertical axis. Generally speaking, the kingpin forms, together with the plane of the deck, an angle that is not a right angle.

The skateboard trucks, despite their simplicity, fulfill several functions. First, they are means for fixing the wheels to the deck which enable the skater to direct the deck. Second, the presence of the elastomeric elements produces a resistance to the forces generated by the skater to pivot the deck, and thereby prevents unexpected changes in direction. Finally, these same elastomers ensure a force for returning the axle in a neutral position after a change in direction.

The construction of skateboard decks uses several types of materials including plastic materials, wood, and composite materials, in particular. Each of these materials has specific characteristics and advantages.

For skateboarding, which involves performing numerous figures and aerial jumps, the decks entirely constructed with veneered wood are preferred. In general, seven plies of constant thickness are coated with glue before being hot pressed. This construction mode is less expensive for small scale manufacture than the molding technique. Furthermore, the decks manufactured by this process have very good dynamic characteristics.

The dynamic characteristics of a deck include, among others, what is known as the "pop" in the skateboarding community. Pop refers to the capacity of a deck to propel the skater in the air, after the latter exerts a substantial pressure on the rear portion of the deck. The origin of the term "pop" lies in the sound made by the rear end of the deck, or tail, when it touches the ground.

The various types of decks have a pop that differs not only due to their geometric characteristics, but also to the properties of their constituent materials which modify the sound produced during contact between the deck and the ground. The pop of a deck is important especially as it is the basis of one of the fundamental figures performed in skateboarding, viz., the ollie.

The decks made of veneered wood are generally preferred by skateboarders. However, these decks have numerous disadvantages. In view of their rigidity, these decks are relatively heavy. In addition, they do not resist well the wear and tear associated with normal use including that caused by abrasion during frictional contact with various surfaces with which contact is made during skateboarding. The edges of the decks become rasped after minimum use, which can present risks for the skater. Thus, when the skater grabs the deck, he/she runs the risk of being cut by a splinter.

The trucks, whose base plate is typically fixed by four screws extending through the deck, demarcate zones where the deck is weakened. So as not to hinder the displacement of the skater's feet along the deck, the head of the screws used for fixing the trucks should not extend beyond the top surface of the deck. It is then necessary to chamfer the screw holes, which weakens the deck all the more and generates incipient breaks.

It is during jump landing that the risks of fracture are the most substantial. The deck often breaks off clean between the end thereof and the base of the truck. In most cases, the deck is sheared directly at the edge of the base of the truck.

One of the solutions to this problem consists of increasing the number of layers in the deck. In the case of a deck made of plywood, it would be necessary to add from two to four plies to the six or seven plies that are commonly used for making the deck. However, a deck having eight to eleven plies would be about 50% heavier, which would considerably limit the possibilities for aerial figures. Furthermore, it would be practically impossible to improve the pop of the deck, because it would be too rigid.

Another problem faced by the manufacturers of skateboard decks is created by the so-called "slide" figures performed in this sport. Indeed, numerous phases in the movement of the rider consist of sliding the deck on surfaces such as metallic rails, ledges of concrete walls, sidewalks. Reference is made to noseslide and tailslide for which the lower portion of the deck that is located between the truck and the front or rear end of the deck is in contact with the element (such as a curb, bench, handrail, table, etc.) on which one is sliding. Reference is also made to rockslide where it is the portion between the two trucks that slides on the element on which one is sliding. Of course, these practices damage the deck considerably, especially when the latter is composed of a plurality of superimposed layers, because the surface layers are quickly worn by abrasion.

In the case of a deck made of plywood and varnish, the varnish layer disappears after a few slides, and the surface layer itself erodes with each slide. Moreover, since wood has a high coefficient of friction, the slide figures lack amplitude.

It is partly to resolve this problem that it is envisioned to glue, after manufacture of the deck, metallic or plastic elements, called sliders, which protect the deck from abrasion and facilitate the slide. However, the added elements do not hold well beneath the deck.

SUMMARY OF THE INVENTION

An object of the present invention is to overcome the aforementioned disadvantages and, in particular, to propose a skateboard deck of the type including a plurality of layers whose strength is increased, and which enables better slides.

Another object of the invention is to increase the break resistance of the deck while increasing the pop thereof.

One of the objects of the invention is also to simplify the current deck/truck system so as to facilitate the assembly and holding of the trucks on the deck, and to make the entire skateboard lighter so as to increase its performance.

To this end, the invention includes a deck having a plurality of layers, at least four of which have a constant or substantially constant thickness, and which include an upper surface layer, a lower surface layer, and several intermediate layers, the deck also including at least one reinforcement arranged in the area of at least one of the zones for fixing the trucks. This reinforcement includes at least one portion which, along a transverse plane, is inserted between the upper surface layer and the lower surface layer.

Such a deck is thus more solid while preserving the advantages of a multilayer construction, especially the advantages of a veneered wood construction.

In a preferred embodiment of the invention, the reinforcements do not have a uniform cross-section. They have a profiled cross-section whose thickest zones are located in the area where the trucks are fixed.

In a preferred embodiment of the invention, the reinforcements include a projecting portion that extends through the lower surface layer, this projecting portion receiving the pivot of the hanger and having a smooth surface.

In another embodiment of the invention, the reinforcement plate is inserted between two intermediate plies and has a contour that is equivalent to the general contour of the deck.

One of the principles underlying the invention comprises inserting one or several reinforcements within the plies of the deck during the shaping step. The reinforcement(s) is (are) arranged so as to increase the resistance of the weak zones, including the tail, nose, and center. These reinforcements also contribute to the rigidity of the deck, and can be prestressed to increase the responsiveness of the deck. The material used for these inserts optimizes the weight, the rigidity and the strength of the finished deck.

Furthermore, the presence of these reinforcements does not make it absolutely necessary to bore four through holes for fixing the deck.

The invention also relates to a multi-layered deck, in which the base plate of the truck is integrated in the deck. Thus, it is no longer necessary to weaken the deck by boring and countersinking four through holes for fixing each base plate of the truck.

To this end, the reinforcements of the skateboard deck according to one of the embodiments of the invention are pierced with a bore whose axis forms, together with the plane of the deck, an angle other than a right angle. This bore is used for the passage of the kingpin bolt of the truck.

In other words, this includes using the lower surface layer of the deck itself to mount the hanger without having to use a base plate, as is currently the case. This feature of the invention is to provide the deck, on its lower portion and in the area of the trucks, with a shape that guarantees the functions that are usually carried out by the base plate of the truck, i.e., ensuring the support of the upper elastomeric buffer and the receiving of the end of the pivot of the hanger in a pivot cup provided in the lower surface of the deck.

In one embodiment of the invention, the lower surface layer serves as a base plate, and the fixing of the truck, comprised in this case by the axle and the hanger only, is obtained by the kingpin bolt.

In another embodiment of the invention, the base plate of the truck is integrated within the deck itself during the gluing/pressing of the various plies to one another.

In yet another embodiment of the invention, the base plate only includes the boss portion, which is extended toward the end of the deck so as to constitute a slider. This half base plate is fixed directly to the deck during the gluing of the plies. It can also be glued after the deck is completely finished. Regardless of the method selected, the fixing of the base plate does not require a plurality of fixing screws that extend through and weaken the deck.

The invention also relates to a multi-layered deck including reinforcements, one of the portions of which projects and extends through the lower surface layer, such that the projecting portion serves as a slider.

BRIEF DESCRIPTION OF DRAWINGS

The present invention also relates to the characteristics that will become apparent from the description that follows, with reference to the annexed drawings showing, by way of non-limiting examples, four embodiments of the invention, and in which.

DETAILED DESCRIPTION OF THE INVENTION

Figure 1:
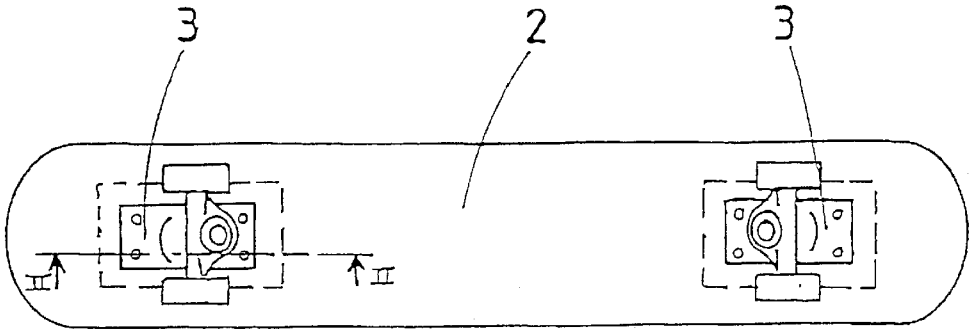
FIG. 1 is a bottom view of a skateboard deck according to a first embodiment of the invention.

FIG. 1 shows a bottom view of a skateboard deck 1 according to a first embodiment of the invention. The skateboard comprises a deck 2 and two trucks 3, one of which is fixed at the front and the other at the rear on the lower surface of this deck. Each of these trucks is used for fixing two wheels.

Figure 2:
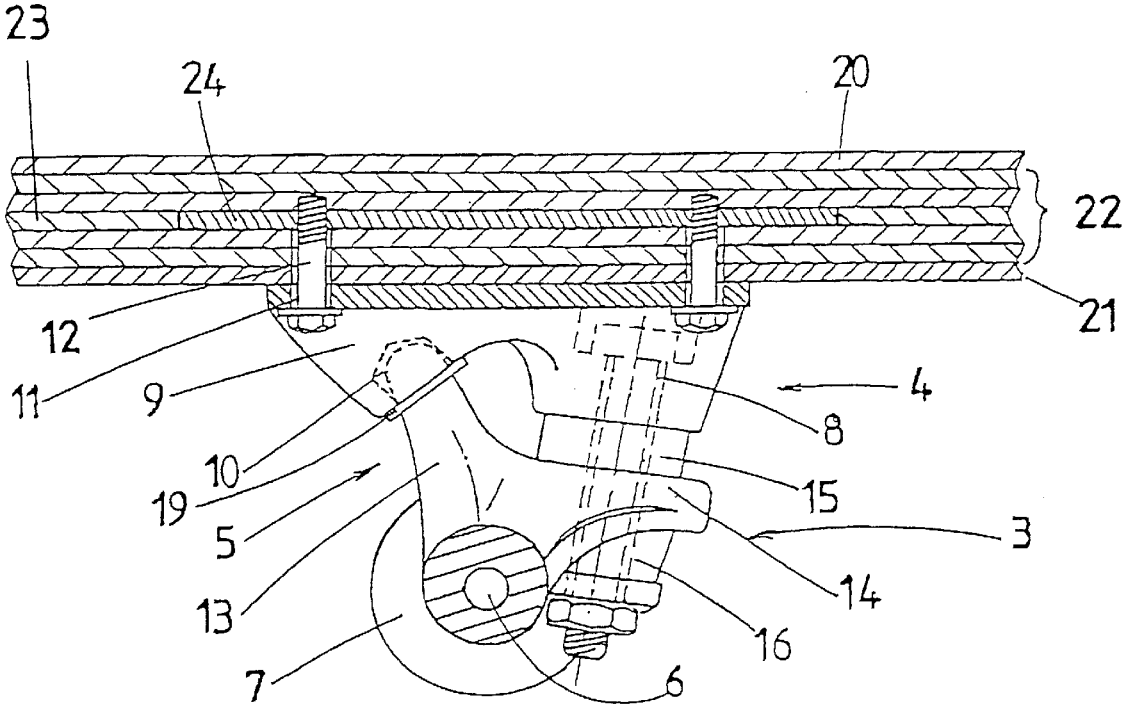
FIG. 2 is a partial cross-sectional view along the line II—II of the deck described in FIG. 1.

FIG. 2 shows a partial longitudinal cross-sectional view of the skateboard deck described in FIG. 1. This figure shows the truck 3 constituted of two elements, a base plate 4 used for attachment to the deck 2, and a bridge 5, also called a hanger, that is used for fixing the axle 6 and the wheels 7. A base 8, bored with a through hole, is provided on one of the portions of the base plate 4.

Another portion of the base plate 4 includes a boss 9 in which a pivot cup 10 is provided. The periphery of the base plate 4 is bored with four holes 11, two of which are shown here and in which the screws 12 for fixing the truck 3 to the deck 2 are inserted. The hanger 5 is composed of three parts, an axle 6 that is used for fixing the two wheels 7, a pivot 13 adapted to be received in the pivot cup of the boss 9, and a ring 14. The upper surface of the ring 14 is in contact with an upper buffer 15 made of elastomer, whereas the lower surface of the ring is in contact with a lower buffer 16 made of elastomer.

The ring, the base of the base plate and the two elastomeric lower and upper buffers in the assembly thus constituted are held together by a kingpin 17. This kingpin 17 includes a bolt 18 whose head is retained by a shoulder that is present in the bore of the base. The bolt then extends successively through the upper buffer, the ring, the lower buffer, a washer, and a tightening nut. The tightening of the bolt is carried out by a nut that maintains the hanger against the base. The tightening of the nut on the bolt determines the hardness of the truck 3. The end of the pivot 13 has a rounded shape. The latter penetrates into the pivot cup provided in the boss of the base plate. The separation between this end of the pivot 13 and the inner surface of the pivot cup is made of a piece made of a plastic or synthetic material called a pivot bushing 19.

The deck itself includes a plurality of layers, including an upper surface layer 20 on which the skater takes position, a lower surface layer 21 and five intermediate layers 22, each of the layers being made of wood.

The various layers are constituted of plies made of wood. The central ply 23 includes an opening 33 provided to receive a reinforcement plate 24. The reinforcement plate 24 has a thickness that is similar to that of the central ply 23. Its area is sufficient so that four holes corresponding to the four holes 11 for fixing the base plate 4 of the truck 3 are made thereon. These holes are threaded to fix the truck on the deck more quickly. The material used for this reinforcement plate is stronger than the ply in which the latter is inserted. Thus, the rigidity and strength of the finished deck are optimized. Furthermore, the holes for fixing the truck on the deck do not extend through the latter, which makes it possible to further reduce the risks of breaking.

Due to these dynamic characteristics, the insert can also increase the responsiveness of the deck and its pop.

The process for manufacturing such a deck includes the following steps.

The first step comprises preparing the various plies forming the deck. This step also includes cutting out the openings 33 in the central ply, these opening having exactly the contour of the reinforcement plate(s) to be inserted in the deck.

The second step comprises gluing the plies.

The third step comprises assembling the plies and the reinforcements in their respective relative position. Next, the molding to shape is carried out and the deck is placed under press.

Finally, the last step includes the routering and finishing of the deck so as to provide it with its final form.

Figure 3:
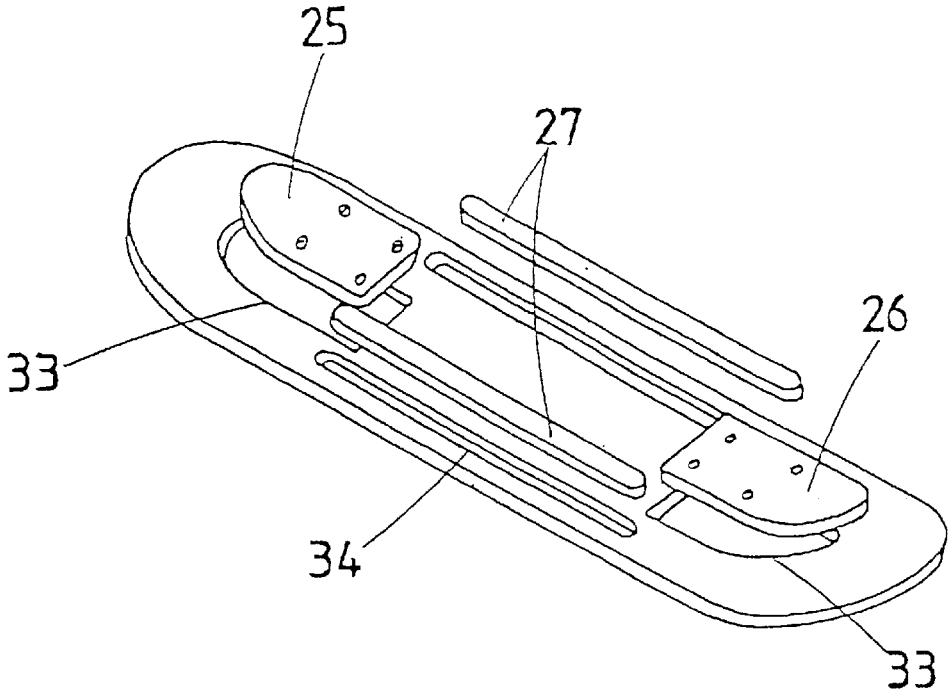
FIG. 3 is a perspective view of the central ply and of the reinforcement plates according to a variation of the first embodiment of the invention.

FIG. 3 shows a central ply 23 in which openings 33 are provided. These openings 33 are provided to receive the front 25 and rear 26 reinforcement plates used for fixing the trucks. Recesses 34 are also provided for the insertion of the lateral reinforcements 27.

Figure 4:
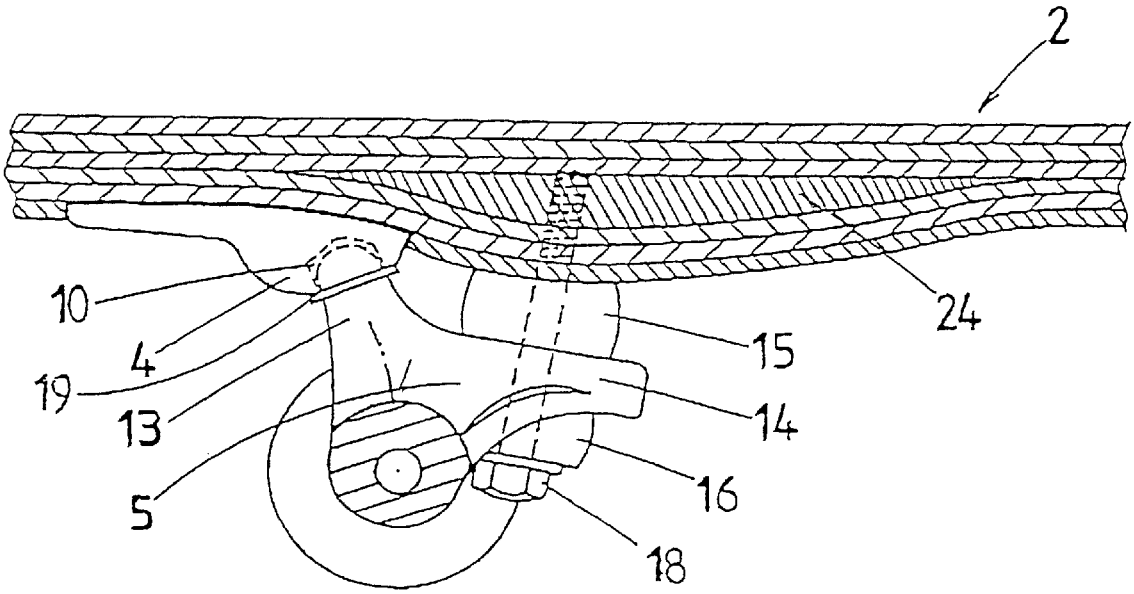
FIG. 4 is a view, similar to FIG. 2, of a skateboard deck according to a second embodiment of the invention.

FIG. 4 shows a cross-sectional view, similar to that of FIG. 1, of a skateboard deck according to a second embodiment of the invention.

The reinforcement plate 24 in this figure includes a cross-section profiled such that the thickest zone is in the center thereof, and that the thickness is reduced from the center toward the periphery until it is eliminated, that is, the reinforcement 24 has a non-uniform thickness, i.e., a non-uniform vertical dimension at least in longitudinal cross-section, as shown. The base plate 4 is limited to one plate in which the pivot cup adapted to receive the pivot of the hanger is provided.

The base plate 4 also includes a planar portion that is extended toward the front end of the deck in the case of the front truck, or rear end in the case of the rear truck. The base plate 4 is inserted in an opening provided in the lower surface ply of the deck, and is in contact with the first intermediate ply thereof.

As in the preceding embodiment, the hanger 5 includes an axle 6 on which two wheels are fixed, a pivot 13 whose rounded end is housed in the pivot cup 10 of the base plate 4, and a ring 14. The ring 14 is held against the deck 2 by means of the kingpin 17. The kingpin 17, whose head presses against a washer, successively extends through the lower elastomeric buffer 16, the ring 14 of the hanger 5, the upper elastomeric buffer 15, and the three lower plies of the deck so as to be screwed into the reinforcement plate 24. Due to the profiled shape of the reinforcement plate, it is no longer necessary to make an opening in the central ply. Furthermore, the deck can be provided with a substantial thickness only in the zone where the latter is rendered necessary by the presence of the truck. In the remainder of the deck 2, a smaller thickness can be maintained.

Given that the upper elastomeric buffer 15 is in direct contact with the lower surface ply of the deck, it is not necessary to have a base. This elimination of the base enables a non-negligible weight gain out of the total weight of the deck.

The process for manufacturing the deck according to the second embodiment of the invention is identical to that of the deck according to the first embodiment, except that the central ply is not cutout, and that the base plate is integrated in the deck when the glued plies are inserted in the mold. Thus, the use of screws and the boring of the deck for fixing the base plate are avoided.

Figure 5:
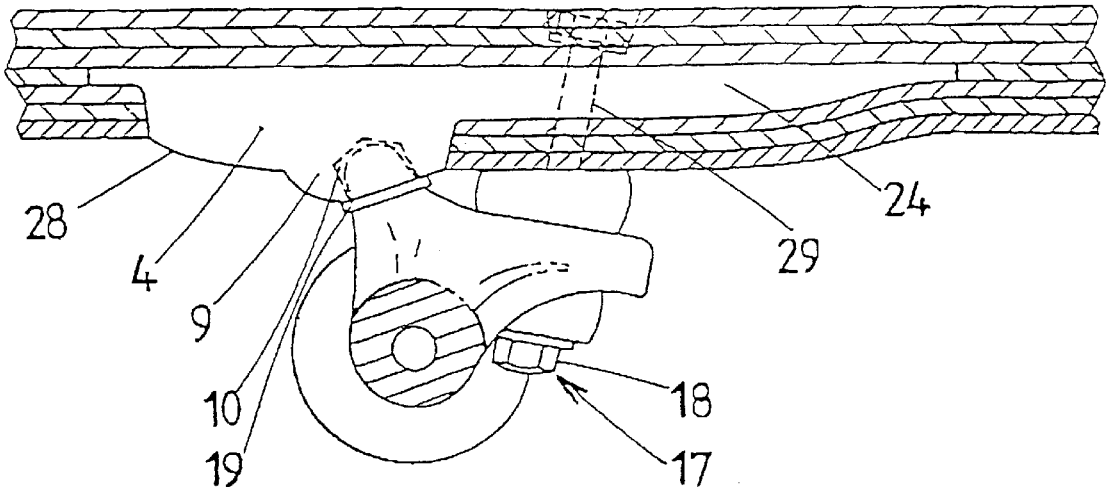
FIG. 5 is a view, similar to FIG. 2, of a skateboard deck according to a third embodiment of the invention.

FIG. 5 shows a cross-sectional view, similar to FIG. 1, of a skateboard 1 according to a third embodiment of the invention. In this new embodiment of the invention, the reinforcement plate 24 and the base plate 4 form an integral piece, i.e., as shown in FIG. 4, the reinforcement plate 24 and the base plate form a single piece. This integral, or unitary, piece, which will continued to be referred to as a reinforcement, includes a base whose thickness corresponds to that of the central ply, and whose outer contour is identical to an opening provided in this central ply.

This reinforcement also includes a projecting portion extending through the lower surface layer, constituted by the boss 9 in which the pivot cup 10 and the slider 28 are arranged. This projecting portion is inserted in one of the corresponding openings provided in each of the lower plies of the deck. A bore 29 enabling the passage of the kingpin bolt 18 is also provided in the reinforcement 24.

The slider 28 is a portion of the reinforcement plate 24 projecting from the lower surface of the deck. It is this portion that is in contact with the surfaces, the edges or rails on which the skater wishes to slide.

Figure 6:
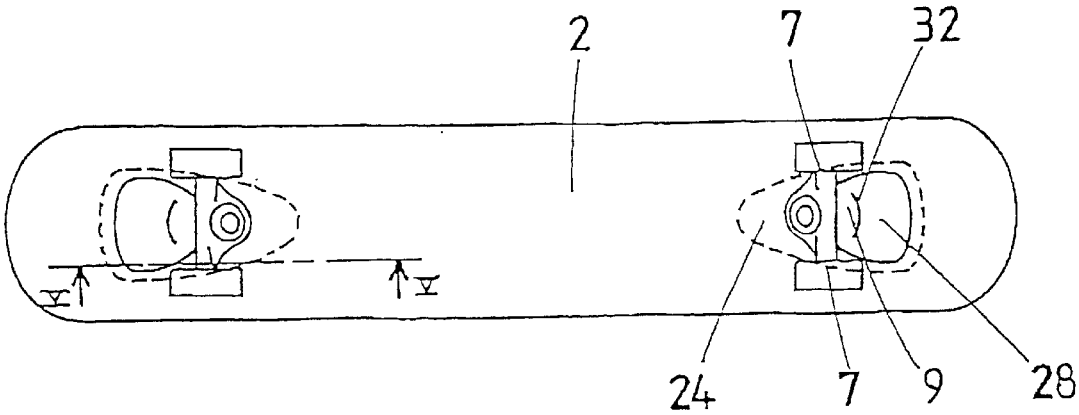
FIG. 6 is a bottom view of the skateboard deck described in FIG. 5.

FIG. 6 shows a bottom view of the skateboard deck 2 according to the third embodiment of the invention. The contours of the reinforcement plate 24 are shown therein in a dotted line. In the apparent portion of the reinforcement plate, the slider 28 is separated from the boss 9 by a curved edge. The slide figures are performed by sliding on the slider 28 and against this edge 32. The presence of this edge prevents the element on which one slides from coming into contact with the wheels or with the hanger.

Figure 7:
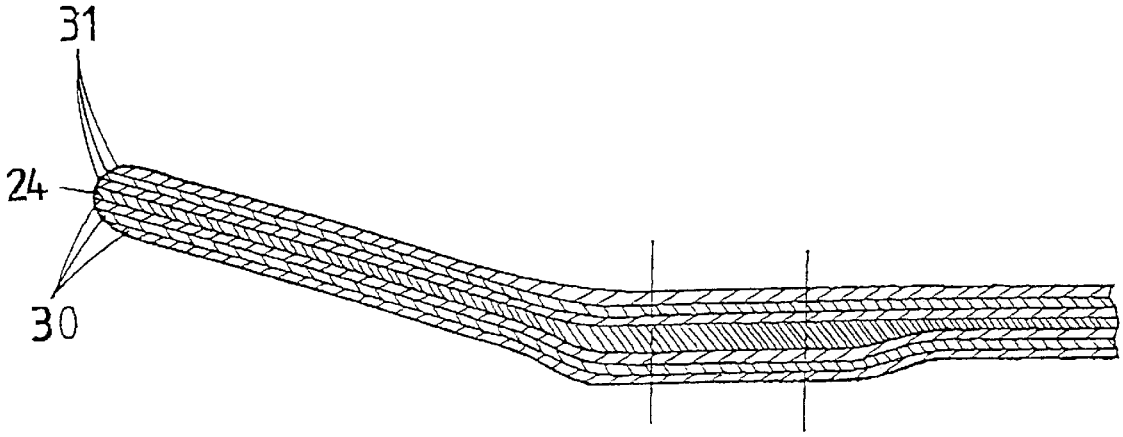
FIG. 7 is a cross-sectional view of the front end of a skateboard deck according to a fourth embodiment of the invention.

FIG. 7 shows a cross-section of the front end of a deck according to a fourth embodiment of the invention. It includes lower plies and upper plies. These plies are thin layers of wood, especially maple wood. The reinforcement plate 24 has a contour that corresponds exactly to the outer contour of the finished deck. The reinforcement plate 24 is inserted between an upper intermediate ply 31 and a lower intermediate ply 30. In the zone adapted for fixing the truck, the reinforcement plate includes a thickening. The deck thus obtained is more rigid, in particular in the area of the trucks, and the trucks can be fixed in a known fashion by boring the assembly thus formed. The reinforcement plate is a wooden core machined flat, having a curve of varying thickness. Similar to the plies, the reinforcement is then glued, and then placed in the mold before pressing. In this example, the deck 2 is adapted to be used equipped with standard trucks, and the position of the screws for fixing the base plate of the front truck is shown in a thin line.

The invention is not limited to the few particular embodiments that have been described hereinabove, by way of non-limiting examples, but it includes any combination of its various constituent characteristics and other variations within the scope of the following claims.

Nomenclature

2—Deck
3—Truck
4—Base Plate
5—Hanger
6—Axle
7—Wheel
8—Base
9—Boss
10—Pivot cup
11—Hole
12—Screw
13—Pivot
14—Ring
15—Upper buffer
16—Lower buffer
17—Kingpin
18—Kingpin bolt
19—Pivot bushing
20—Upper surface layer
21—Lower surface layer
22—Intermediate layers
23—Central ply
24—Reinforcement plate
25—Front reinforcement
26—Rear reinforcement
27—Lateral reinforcements
28—Slider
29—Bore
30—Lower ply
31—Upper ply
32—Edge
33—Opening
34—Recess

What is claimed is:

1. A skateboard deck comprising:

a plurality of layers including an upper surface layer on which the skater takes position, a lower surface layer in an area in which wheels of the skateboard are to be positioned, and one or more intermediate layers;

at least one reinforcement provided in at least one of the following zones: a front of the deck, in the area where front wheels are to be fixed; a rear of the deck, in an area where rear wheels are to be fixed; on a periphery of the deck;

said reinforcement being inserted between the upper surface layer and the lower surface layer; and said reinforcement has a non-uniform cross-section in a vertical cross-section.

2. A skateboard deck comprising:

a plurality of layers including an upper surface layer on which the skater takes position, a lower surface layer in an area in which wheels of the skateboard are to be positioned, and one or more intermediate layers;

at least one reinforcement provided in at least one of the following zones: a front of the deck, in the area where front wheels are to be fixed; a rear of the deck, in an area where rear wheels are to be fixed; on a periphery of the deck;

said reinforcement being inserted between the upper surface layer and the lower surface layer;

said reinforcement has a non-uniform cross-section in a vertical cross-section;

said one or more intermediate layers comprises at least two intermediate layers;

said reinforcement is positioned between said two intermediate layers; and an opening is made between the two intermediate layers and, said reinforcement is placed in said opening.

3. A skateboard deck comprising:

a plurality of layers including an upper surface layer on which the skater takes position, a lower surface layer in an area in which wheels of the skateboard are to be positioned, and one or more intermediate layers;

at least one reinforcement provided in at least one of the following zones: a front of the deck, in the area where front wheels are to be fixed; a rear of the deck, in an area where rear wheels are to be fixed; on a periphery of the deck;

said reinforcement being inserted between the upper surface layer and the lower surface layer;

said reinforcement has a non-uniform cross-section in a vertical cross-section;

said one or more intermediate layers comprises at least two intermediate layers;

said reinforcement is positioned between said two intermediate layers;

said skateboard deck further including a truck base plate, said base plate including a boss in which a pivot cup is provided to receive the pivot of the hanger of a truck; and said base plate includes a slider provided to facilitate sliding.

4. A skateboard including:

a skateboard deck comprising a plurality of layers including an upper surface layer on which a skater takes position, a lower surface layer in an area in which wheels of the skateboard are to be positioned, and one or more intermediate layers;

a base plate fixed to the deck and comprising a pivot cup;

a hanger supporting an axle, two wheels being mounted on said axle and comprising a pivot;

a fixing device to maintain said pivot in said pivot cup and not extending through said base plate.

5. A skateboard according to claim 4, wherein:

said fixing device extends through said deck at least partially.

6. A skateboard according to claim 4, wherein:

said base plate includes a slider.

7. A skateboard deck comprising:

a plurality of layers including an upper surface layer on which the skater takes position, a lower surface layer in an area in which wheels of the skateboard are to be positioned, and one or more intermediate layers;

at least one reinforcement provided in at least one of the following zones: a front of the deck, in the area where front wheels are to be fixed; a rear of the deck, in an area where rear wheels are to be fixed; on a periphery of the deck;

said reinforcement being inserted between the upper surface layer and the lower surface layer; and said reinforcement has a non-uniform thickness along a longitudinal cross-section.

8. A skateboard deck according to claim 7, wherein:

said plurality of layers includes at least four layers made of wood having a constant thickness.

9. A skateboard deck according to claim 7, wherein:

said one or more intermediate layers comprises at least two intermediate layers; and said reinforcement is positioned between said two intermediate layers.

10. A skateboard deck according to claim 7, wherein:

said reinforcement has a cross-section profiled such that thicker portions are arranged in areas where trucks are to be fixed.

11. A skateboard deck according to claim 9, wherein:

at least one of said at least two intermediate layers includes an opening and said reinforcement is placed in said opening.

12. A skateboard deck according to claim 9, wherein:

said reinforcement has a contour that merges with an outer contour of the deck.

13. A skateboard deck according to claim 9, wherein:

said reinforcement is located in an area of the trucks bored with a cylindrical hole having an axis forming, together with a plane of the deck, an angle other than a right angle.

14. A skateboard deck according to claim 9, wherein:

said reinforcement also includes a projecting portion extending through the lower surface layer of the deck.

15. A skateboard deck according to claim 14, wherein the projecting portion includes a slider provided to facilitate the slide.

16. A skateboard deck according to claim 9, further including a truck base plate, said base plate including a boss in which a pivot cup is provided to receive the pivot of the hanger of a truck.

17. A skateboard deck according to claim 16, wherein:

said base plate and said reinforcement are adjacent.

18. A skateboard deck according to claim 17, wherein:

said base plate and said reinforcement form a single piece.

* * * * *